US005535825A

United States Patent [19]

Hickerson

[11] Patent Number: 5,535,825

[45] Date of Patent: Jul. 16, 1996

[54] HEAT CONTROLLED OIL PRODUCTION SYSTEM AND METHOD

[76] Inventor: Russell D. Hickerson, 1105 Essex, Odessa, Tex. 79760

[21] Appl. No.: 232,612

[22] Filed: Apr. 25, 1994

[51] Int. Cl.[6] ..... E21B 36/00; E21B 43/12; E21B 43/14

[52] U.S. Cl. ..... 166/302; 166/57; 166/313; 166/370

[58] Field of Search ..... 166/57, 302, 369, 166/370, 313

[56] References Cited

U.S. PATENT DOCUMENTS

| | | | |
|---|---|---|---|
| 1,140,982 | 5/1915 | Huff | 166/302 |
| 1,901,141 | 3/1933 | Battelle | 166/57 X |
| 3,066,737 | 12/1962 | Baldwin | 166/57 |
| 3,100,531 | 8/1963 | Brown | 166/313 X |
| 3,456,735 | 7/1969 | McDougall et al. | 166/57 X |
| 3,685,583 | 8/1972 | Pharen | 166/302 |
| 3,763,935 | 10/1973 | Perkins | 166/57 X |
| 4,099,564 | 7/1978 | Hutchinson | 166/241 |
| 4,844,156 | 7/1989 | Hesh | 166/370 X |

FOREIGN PATENT DOCUMENTS

| | | | |
|---|---|---|---|
| 1409703 | 1/1969 | Germany | 166/369 |
| 625021 | 9/1961 | Italy | 166/369 |

*Primary Examiner*—Hoang C. Dang
*Attorney, Agent, or Firm*—Milburn & Peterson

[57] ABSTRACT

The heat control production system and method for an oil well utilizes a noncorrosive gas compatible with crude oil fire hazards to provide an insulating annulus between the production tubing string of an oil well and the bore hole or casing or other tubing string surrounding the production tubing string by pressurizing the insulating annulus from the source of gas such that crude oil from the oil reservoir enters the insulating annulus and interfaces with the gas intermediate the surface and the oil reservoir whereby the insulating annulus provides minimal heat transfer to allow the crude oil produced through the production tubing string to reach the surface at a preselected temperature up to the oil reservoir temperature which avoids undesirable precipitation or gelling of paraffinic hydrocarbons from heat loss to the overburden of the oil well.

6 Claims, 4 Drawing Sheets

HEAT CONTROLLED OIL PRODUCTION SYSTEM AND METHOD

BACKGROUND OF THE INVENTION

This invention relates to production of oil and gas wells, and particularly provides for a method for producing oil at a temperature adjustable from the formation temperature to a lesser temperature as desired.

Because of the normal decrease in temperature of produced crude oil from the temperature of the oil bearing formation, long chain paraffinic hydrocarbons, asphaltenes, and resins, which are often contained in crude oil, have a tendency to precipitate. This is caused by the cooling which occurs as such crude oil moves towards the surface of the wellbore being sufficient to cause precipitation of the paraffinic hydrocarbons and other components. Precipitation, of course, plugs the well and lines if the material is not removed at frequent intervals. Such removal requires the oil well to be shut in and treating methods to be performed to remove the precipitated hydrocarbons. The removal is done by running scrapers through the production tubing strings or treating the well with hot oil or solvents. These are known methods for treating oil wells to overcome the problems.

One technique disclosed in U.S. Pat. No. 3,456,735, of McDougall is a method of completing wells to prevent paraffin deposits. The method described requires the installation of a production packer between the casing and the production tubing string a short distance above the producing zone; next packer fluid is located within the annulus above the packer to equalize the pressure across it and prevent leaks; and then installation of rigid foam or similar porous material in the annulus surrounding the production tubing string and an outer tubing string or casing above the packer fluid. McDougall discloses several ways of obtaining the insulating material in the annulus surrounding the production tubing string including in situ formation.

The method of McDougall poses problems of maintaining the insulation when the production tubing string must be pulled for reworking the well and then reinstalled. Such procedure would require reinsulation of the production tubing string with additional foam producing material.

U.S. Pat. No. 1,901,141, issued to Battelle discloses a method of automatic oil well control to maintain the temperature and conditions of the hydrocarbon oils. Battelle utilizes a well construction that includes a casing set in a borehole extending below the oil bearing strata, a production tubing string within the casing which extends below the oil bearing strata near the bottom of the casing, and a pressure tubing string surrounding the production tubing string which extends to just below the oil bearing strata and is open to the oil bearing strata. The casing is perforated in the oil bearing strata and includes a packer above the oil bearing strata which prevents oil moving past the packer in the casing. The oil forms a pool in the casing below the perforations. Battelle requires a sealed, leak proof casing and a leak proof pressure tubing string surrounding the production tubing string. The pressure tubing string is connected at the surface to a pressure control valve which when activated by certain pressure settings will open or close a valve in the flow line leading from the top of the production tubing string to produce oil into a collection vessel. The pressure tubing string which surrounds the production tubing string is open to the crude oil and thus the pressure of the formation forces oil into the pressure tubing string until such time as the pressure has sufficiently built up to cause the pressure control valve to operate and open the production tubing string valve. Once the pressure in the pressure tubing string decreases sufficiently from production of crude oil, the pressure control valve will operate to close the production valve in the flow line leading from the top of the production tubing string. By this arrangement Battelle produces oil at a certain range of pressure and the pressure tubing string provides some measure of insulation surrounding the production tubing string. The casing above the packer does not have any offsetting pressure to retain the packer in place and to equalize the pressure across the packer to prevent leaks.

U.S. Pat. No. 3,763,935 of Perkins describes a method for thermally insulating the interior of one or more sections of casing, tubing, or other pipe and particularly in the permafrost zone of a wellbore. Perkins provides insulation by using closed annular zones in casing sections filled with a gas which will remain in the vapor state at the temperatures encountered in the wellbore. Where the section of casings are jointed he uses a solid insulating material surrounding the joint to provide insulation. The primary purpose of the Perkins method is to avoid damage of the permafrost zone around the well. This arrangement requires replacing the solid insulation whenever rework of the casing is required.

U.S. Pat. No. 3,685,583 of Phares describes another technique to protect the permafrost zone around an oil and gas well. Phares provides an atmospheric air flow passageway arranged to direct atmospheric air down along an outermost casing in the wellbore and return the air flow through the annulus between an inner tubing string or second casing and the production tubing string. In this arrangement cold air travels along a path next to the permafrost region to a distance therebelow and is then heated by the oil in the production tubing string near the bottom of the casing and flows upward around the production tubing string, thus the natural convection from heating the air permits the downward flow next to the permafrost region and return flow in the annulus between the production tubing string and the casing.

SUMMARY OF THE INVENTION

The present invention provides a method of insulating the production tubing string in an oil and gas well by the use of inert gas in the annulus surrounding the production tubing string and a concentric tubing string or the casing. A casing is set in a borehole which penetrates the oil strata and then perforated to form an oil reservoir. A production tubing string is positioned within the casing and extends into the oil reservoir of the producing formation. If a second tubing string is used, it extends into the top of the oil reservoir. In operation oil is produced through the production tubing string, and the annulus between the production tubing string and the second concentric tubing string or casing is pressurized by inert gas with the oil entering the lower portion of the casing or concentric tubing string and forming an oil/inert gas interface. By use of the term inert gas, it is intended to cover noncorrosive gaseous substances posing minimal danger in production of oil. Above the interface inert gas provides insulation of the production tubing string from the overburden surrounding the borehole. The production tubing string and concentric tubing string are spaced apart by low-heat conducting centralizers. Low heat conducting centralizers are described in U.S. Pat. No. 4,099,564, dated Jul. 11, 1978, issued to Stanley Hutchison assignor to Chevron Research Company.

With the above arrangement the crude oil temperature could be adjusted from its maximum temperature in the reservoir to a lower temperature as desired by varying the pressure and thus the depth of the interface of the inert gas and the crude oil in the annulus between the casing or the concentric tubing string and the production tubing string. In this manner the temperature can be controlled to avoid the gelling or solidifying of paraffin.

In another aspect of the invention whether or not paraffins are present, the temperature of the crude oil can be controlled at an appropriate reading for other surface treatment processes which may be performed before the crude oil is ready for a refinery.

DETAILED DESCRIPTION OF THE INVENTION

Figure 1:
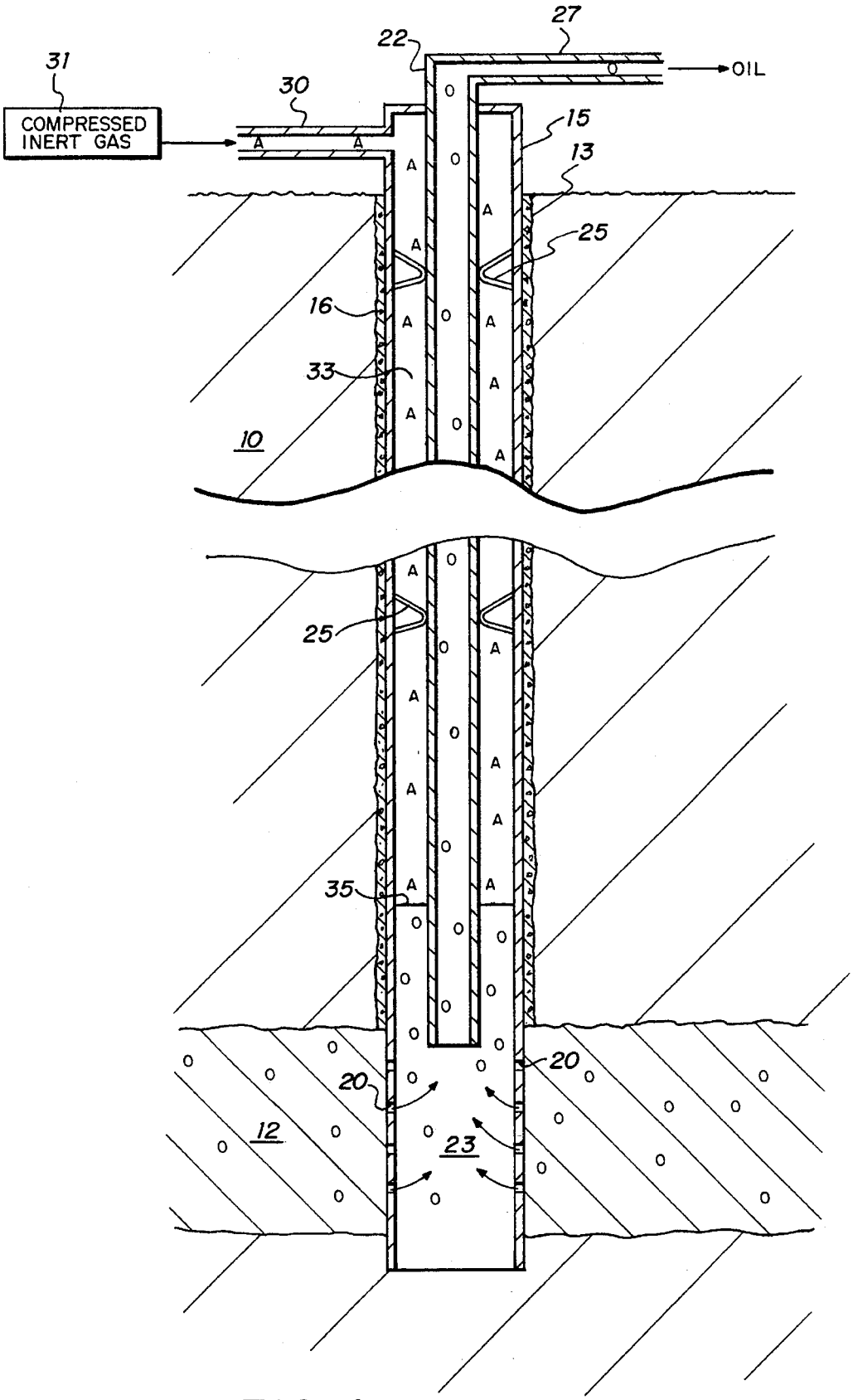
FIG. 1 in the drawings is a schematic representation of an oil well illustrating the use of compressed inert gas to maintain an insulating jacket around the production tubing string of a free flowing oil well.

Referring now particularly to FIG. 1, an earth formation generally referred to as 10 includes oil strata 12. A borehole 13 in the earth formation 10 penetrates the oil strata 12. Casing 15 is cemented in borehole 13 by cement 16. Casing 15 extends into oil strata 12 and has perforations 20 in oil strata 12 which permits migration of oil from oil strata 12 within the casing 15 to form oil pool 23. Production tubing string 22 is telescoped within casing 15, and extends to just above the perforations 20 in casing 15 and into oil pool 23. Production tubing string 22 is equipped with low-heat conducting centralizers 25 which prevents the production tubing string 22 and the casing 15 from touching each other and thus, lose insulation therebetween. Pipe 27 is connected to the top of production tubing string 22 to direct the flow of oil to a collecting vessel (not shown) such as a separator and storage tank.

The casing 15 is coupled to pipe 30 at the surface. Preferably a source 31 of inert gas or other suitable, compatible gas with the oil to be produced is provided. The annulus 33 between production tubing string 22 and casing 15 is pressurized by inert gas from source 31 to form an interface 35 between the inert gas and the oil pool 23 just above the bottom of production tubing string 22.

In operation the interface 35 is adjusted intermediate the lower portion of production tubing string 22 and the upper portion of production tubing string 22 depending on the desired surface temperature of the oil from oil pool 23, as well as, the temperature at which paraffins and other components of the crude oil gel or precipitate.

Figure 2:
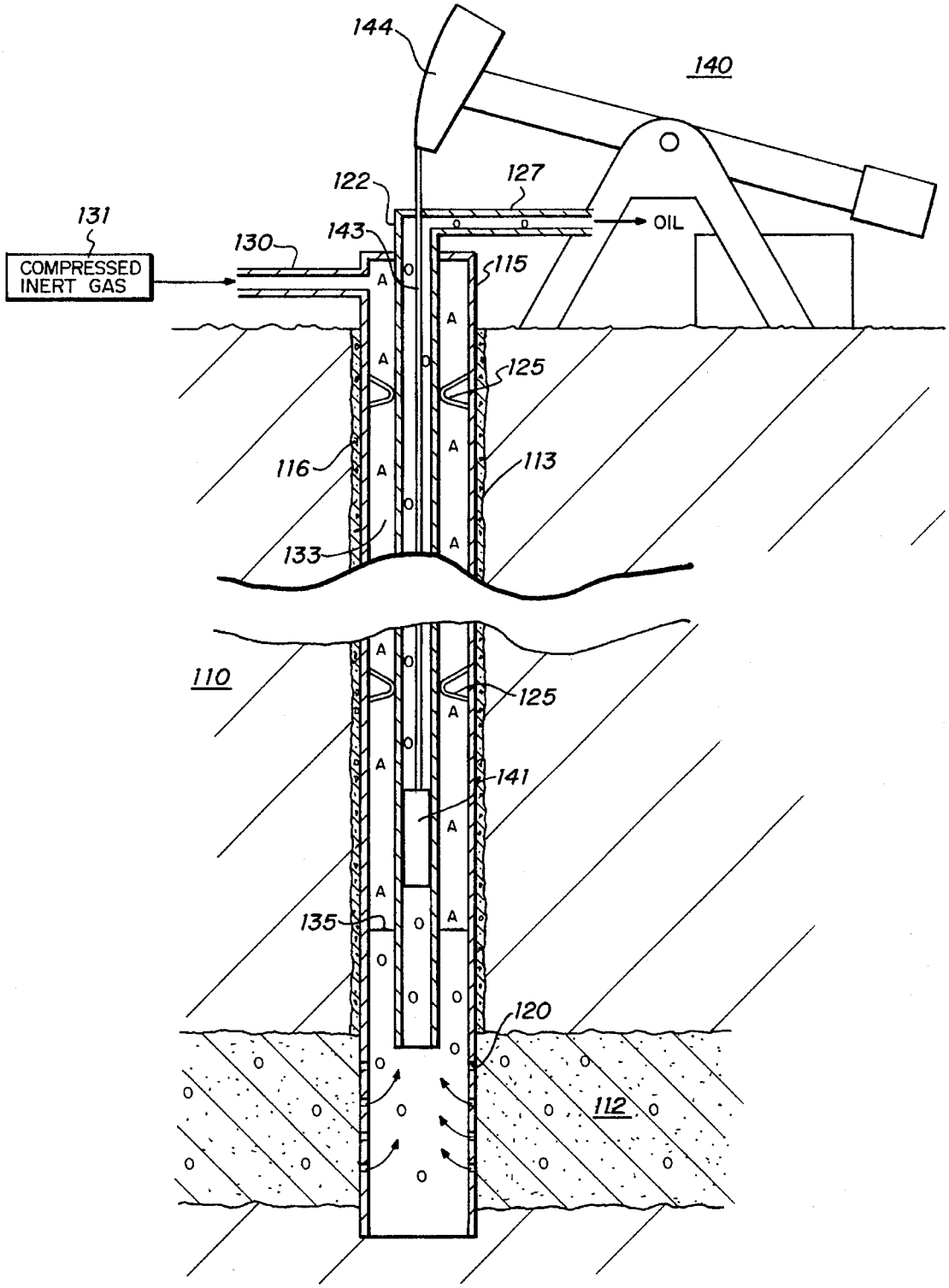
FIG. 2 in the drawings is a schematic representation of an oil well illustrating the use of compressed inert gas to maintain an insulating jacket around the production tubing string of a pumped FIG. 3 in the drawings is a schematic representation of a free flowing oil well illustrating the use of compressed inert gas to maintain an insulating jacket around multiple production tubing strings.

Referring to FIG. 2, an earth formation generally referred to as 110 includes oil strata 112. A borehole 113 in earth formation 110 penetrates the oil strata 112. Casing 115 is cemented in borehole 113 by cement 116. Casing 115 extends into oil strata 112 and has perforations 120 in oil strata 112 which permits migration of oil from oil strata 112 within the casing 115 to form oil pool 123. Production tubing string 122 is telescoped within casing 115, and extends to just above the perforations 120 in casing 115. Production tubing string 122 is equipped with low-heat conducting centralizers 125 which prevents the production tubing string 122 and the casing 115 from touching each other and thus, lose insulation therebetween. Pipe 127 is connected to the top of production tubing string 122 to direct the flow of oil to a collecting vessel (not shown) such as a separator and storage tank.

The casing 115 has a pipe 130 connected at the surface. Preferably a source 131 of inert gas or other suitable, compatible gas with the oil to be produced is provided. The annulus 133 between production tubing string 122 and casing 115 is pressurized by inert gas from source 131 to form an interface 135 between the inert gas and the oil pool 123 just above the bottom of production tubing string 122.

Production tubing string 122 is equipped with a pump jack generally referred as 140 which includes horse head 144. Sucker rod pump 141 positioned near the bottom of production tubing string 122 is connected by sucker rods 143 to horse head 144 of pump jack 140.

In operation the interface 135 is adjusted intermediate the lower portion of the annulus 133 between casing 115 and production tubing string 122 and the upper portion of production tubing string 122 depending on the desired surface temperature of the oil from oil pool 123, as well as, the temperature at which paraffins and other components of the crude oil gel or precipitate.

Since the downhole pressure of oil strata 112 is insufficient to produce the free flowing oil at the surface it is necessary to provide artificial lift means. As FIG. 2 illustrates, downhole pump 141 is operated by pump jack 140 reciprocating horse head 144 and the sucker rods 143 to pump the oil from oil pool 123 through production tubing string 122 and into transfer pipe 127.

It will be understood that as long as the downhole pressure is sufficient to cause oil to rise in casing 115, although not free flowing at the surface, then the oil temperature can be controlled (within limits) by adjusting interface 135 in annulus 133 intermediate the lower portion of the casing 115.

Figure 3:
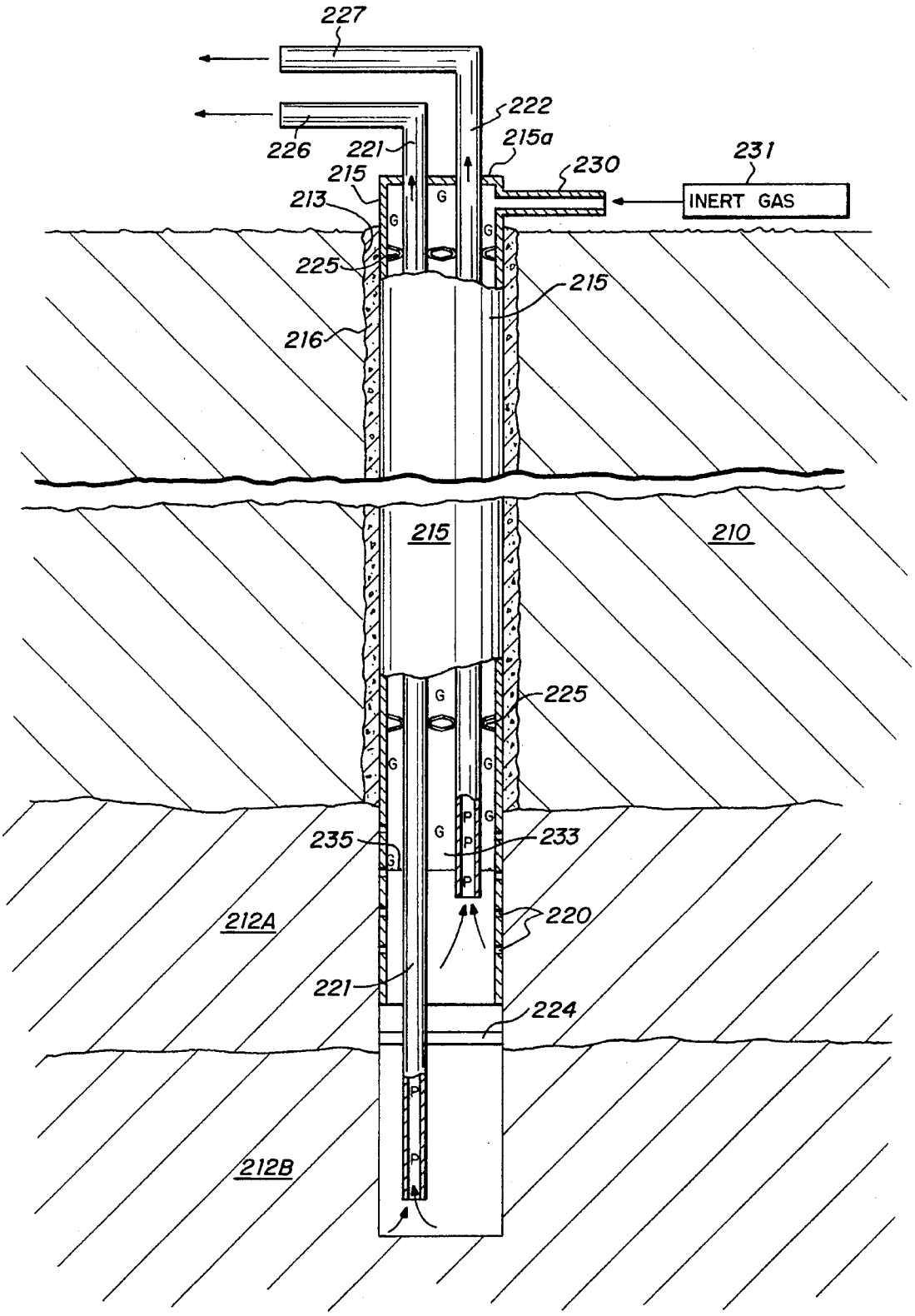

Referring additionally to FIG. 3, an earth formation generally referred to as 210 includes upper oil strata 212A and lower oil strata 212B. A borehole 213 in earth formation 210 penetrates upper oil strata 212A and lower oil strata 212B. Casing 215 is cemented in borehole 213 by cement 216. Casing 215 has perforations 220 which permit migration of oil from upper oil strata 212A through perforations 220 and into casing 215. Production tubing string 221 is telescoped in casing 215 and extends to lower oil strata 212B in borehole 213. A packer 224 separates the upper oil strata 212A from lower oil strata 212B. Production tubing string 222 is telescoped within casing 215 and extends near the bottom of casing 215. Production tubing string 221 and production tubing string 222 are maintained spaced apart from each other and casing 215 by low-heat conducting centralizers 225 to prevent contact between production tubing string 221, production tubing string 222 and casing 215 which would cause loss of insulation therebetween. Pipe 226 is connected at the surface to production tubing string 221 to direct the flow of oil to a collecting vessel (not shown), such as a separator and storage tank. Likewise, pipe 227 is connected at the surface to production tubing string 222 to direct the flow of oil to the same or a different collecting vessel (not shown) as pipe 226, such as a separator and storage tank. The casing 215 is sealed at top 215A around production tubing string 221 and production tubing string 222. Further, the casing 215 is coupled by pipe 230 at the surface to a source 231 of inert gas or other suitable, compatible gas with the oil to be produced is provided. The annulus 233 between casing 215 and production tubing strings 221 and 222 is pressurized to form an interface 235 between the oil being produced from the upper oil strata 212A and the inert gas just above the bottom of production tubing string 222.

In operation the interface 235 is adjusted intermediate the lower portion of production tubing string 222 and the upper portion of production tubing string 222 depending on the desired surface temperature of the oil from the upper oil strata 212A and the lower oil strata 212B, as well as, the temperature at which paraffin and other components of the crude oil gel or precipitate.

It will be understood that production of oil from upper oil strata 212A and lower oil strata 212B is illustrated from a free flowing oil well in which it is necessary to maintain production of oil separate for each oil strata encountered.

Figure 4:
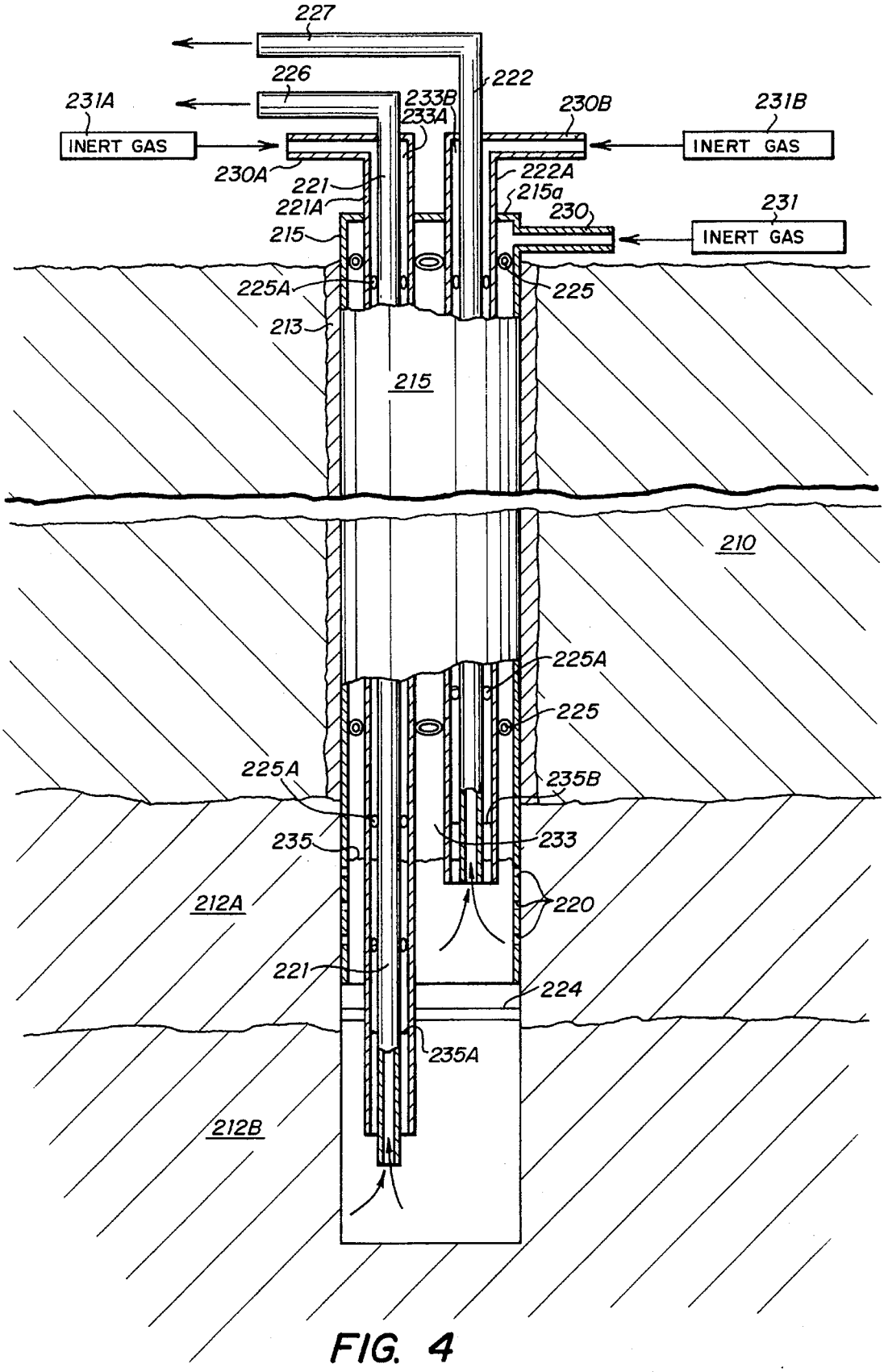
FIG. 4 in the drawings is a schematic representation of a free flowing oil well, similar to FIG. 3, illustrating the use of inert gas to maintain an insulating jacket between the production tubing strings and their respective insulating tubing strings and between the casing and the insulating tubing strings.

Referring now to FIG. 4, there is shown generally the same earth formation and well structure as in FIG. 3 with certain exception and therefore numerals in FIG. 4 referring to structure the same as structure in FIG. 3 will have the same numerals. In FIG. 4, an earth formation generally referred to as 210 includes an upper oil strata 212A and lower oil strata 212B. A borehole 213 in earth formation 210 penetrates upper oil strata 212A and lower oil strata 212B. Casing 215 is cemented in borehole 213 by cement 216. Casing 215 has perforations 220 which permit migration of oil from upper oil strata 212A through perforations 220 and into casing 215. A packer 224 separates the upper oil strata 212A from lower oil strata 212B. Production tubing string 221 is telescoped within tubing string 221A both of which extend through packer 224 into lower oil strata 212B in borehole 213. Production tubing string 222 is telescoped within tubing string 222A both of which extend into upper oil strata 212A in borehole 213. Production tubing string 221 and tubing string 221A are maintained spaced apart from each other by low-heat conducting centralizers 225A. Likewise, production tubing string 222 and tubing string 222A are maintained spaced apart from each other by low-heat conducting centralizers 225A. Further, tubing string 221A and tubing string 222A are maintained spaced apart from each other and casing 215 by low-heat conducting centralizers 225. The low-heat conducting centralizers 225 and 225A avoid loss of insulation between the tubing strings and the casing. Pipe 226 is connected at the surface to production tubing string 221 to direct the flow of oil to a collecting vessel (not shown), such as a separator and storage tank. Likewise, pipe 227 is connected at the surface to production tubing string 222 to direct the flow of oil to the same or a different collecting vessel (not shown) as pipe 226, such as a separator and storage tank. The casing 215 is sealed at top 215A around tubing string 221A and tubing string 222A. Further, the casing 215 is coupled by pipe 230 at the surface to a source 231 of inert gas or other suitable, compatible gas with the oil to be produced. Tubing string 221A is coupled by pipe 230A at the surface to a source 231A of inert gas. Likewise, tubing string 222A is coupled by pipe 230B at the surface to a source 231B of inert gas or other suitable, compatible gas with the oil to be produced. The annulus 233 between casing 215 and tubing strings 221A and 222A is pressurized to form an interface 235 between the oil being produced from the upper oil strata 212A and the inert gas just above the bottom of production tubing string 222. The annulus 233A between production tubing string 221 and tubing string 221A is pressurized to form an interface 235A along production tubing string 221. The annulus 233B between production tubing string 222 and tubing string 222A is pressurized to form an interface 235B along production tubing string 222.

In operation the interface 235 is adjusted intermediate the lower portion of tubing string 222A and the upper portion of tubing string 222A depending on the desired surface temperature of the oil from the upper oil strata 212A and the lower oil strata 212B, as well as, the temperature at which paraffin and other components of the crude oil gel or precipitate. Interface 235A is adjusted intermediate the lower portion of production tubing string 221 for further control of the desired surface temperature of the oil from lower oil strata 212B, as well as, the temperature at which paraffin and other components of the crude oil gel or precipitate. Likewise, interface 235B is adjusted intermediate the lower portion of production tubing string 222 for further control of the desired surface temperature of the oil from upper oil strata 212A, as well as, the temperature at which paraffin and other components of the crude oil gel or precipitate.

It should be understood that although the invention as illustrated in FIG. 1 and FIG. 2 as a single casing and production tubing string of a free flowing or pumped oil well, the invention as exemplified in FIG. 3 will work in multiple zoned oil wells with multiple production tubing strings surrounded by either a single casing or individual tubing strings telescoped with the production tubing string. FIG. 4 illustrates a multiple zoned oil well with a pair of production tubing strings 221 and 222 surrounded by insulated tubing strings 221A and 222A all contained within a single casing 215. In multiple zone operations the temperature can be controlled at temperatures varying from the formation temperature to a lower temperature as desired and sufficient to prevent undesirable precipitation or gelling of paraffinic hydrocarbons from heat loss to the overburden of the oil well.

Further, it should be understood that in many oil wells the casing does not extend beyond the top of the oil bearing strata with the production tubing string extending further down into the oil strata than the casing. Such an open completion oil well would operate in the same manner as illustrated in FIGS. 1 and 2 with the exception that the annulus to be pressurized with the inert gas would be between the production tubing string and the wellbore and casing.

Also, other forms of artificial lift means, such as, hydraulic lifts, submersible pumps, or gas lifts for example, if utilized to produce oil such lifting methods are compatible with the thermal insulation system and method disclosed herein which may be utilized in those production methods.

What is claimed is:

1. A method of producing oil from an oil reservoir at a predetermined temperature upon reaching the surface comprising:

drilling a borehole into the oil bearing strata where an oil reservoir may be encountered;

equipping the borehole with a casing;

placing a tubing string for production of oil within said casing extending into the oil reservoir;

providing a source of gaseous substance communicating with the annulus surrounding the tubing string; and pressurizing the annulus around the tubing string with the gaseous substance at a temperature significantly less than the oil reservoir temperature to establish an interface between the oil and the gaseous substance at a level above the bottom of the tubing string and below the top of the tubing string to limit heat transfer from the oil to the overburden with the oil reaching the surface at the predetermined surface temperature.

2. The method of claim 1 wherein the step of equipping the borehole includes perforating said casing adjacent the oil bearing strata to permit oil to flow within said casing and tubing string.

3. The method of claim 1 wherein the step of pressurizing the annulus includes the step of maintaining the interface between the oil and the gaseous substance at a level which limits heat transfer from the oil to the overburden such that precipitation of paraffinic hydrocarbons is suppressed.

4. In the method of claim 1, the step of placing the tubing string for production of oil includes the step of spacing the tubing string apart from the casing by low heat conducting centralizers.

5. A system for producing oil & gas from an oil reservoir in at least two oil strata at a predetermined surface temperature comprising:

a borehole extending from the surface of the earth through the upper and into the lower oil strata;

a casing within said borehole cemented thereto;

a first production tubing string extending into the upper oil strata having an oil reservoir;

a second production tubing string extending into the lower oil strata having an oil reservoir;

a first insulating tubing string co-extensive with and surrounding the first production tubing string and a second insulating tubing string co-extensive with and surrounding the second production tubing string;

a source of gaseous substance communicating with the first annulus between said first production tubing string and said first insulating tubing string;

a source of gaseous substance communicating with the second annulus between said second production tubing string and said second insulating tubing string; and apparatus for pressurizing said gaseous substance within the first annulus and the second annulus to maintain the oil and the gaseous substance interfaces along the first production tubing string and along the second production tubing string to provide insulating jackets about said first and second production tubing strings.

6. The system of claim 5 wherein low heat conducting centralizers maintain the first production tubing string and the first insulating tubing string spaced apart, and the second production tubing string and the second insulating tubing string spaced apart and the first insulating tubing string and the second insulating tubing string spaced apart from the casing.

* * * * *